US009249766B2

(12) United States Patent
Imai et al.

(10) Patent No.: US 9,249,766 B2
(45) Date of Patent: Feb. 2, 2016

(54) FUEL INJECTOR AND FUEL INJECTION DEVICE USING THE SAME

(71) Applicant: DENSO CORPORATION, Kariya, Aichi-pref. (JP)

(72) Inventors: Keita Imai, Kariya (JP); Eiji Itoh, Anjo (JP)

(73) Assignee: DENSO CORPORATION, Kariya (JP)

( * ) Notice: Subject to any disclaimer, the term of this patent is extended or adjusted under 35 U.S.C. 154(b) by 141 days.

(21) Appl. No.: 14/152,541

(22) Filed: Jan. 10, 2014

(65) Prior Publication Data

US 2014/0197251 A1 Jul. 17, 2014

(30) Foreign Application Priority Data

Jan. 14, 2013 (JP) ..... 2013-4156

(51) Int. Cl.
*F02M 51/06* (2006.01)
*F02M 61/20* (2006.01)

(52) U.S. Cl.
CPC ..... *F02M 51/0664* (2013.01); *F02M 51/0675* (2013.01); *F02M 61/205* (2013.01)

(58) Field of Classification Search
CPC . F02M 51/06; F02M 51/0625; F02M 61/205; F02M 51/0675; F02M 51/0664
USPC ..... 239/585.5
See application file for complete search history.

(56) References Cited

U.S. PATENT DOCUMENTS 5,334,561 A * 8/1994 Matsui ..... B05B 1/00 239/DIG. 19
2010/0320293 A1 12/2010 Ogura et al.
2013/0087639 A1 4/2013 Nakai et al.
2014/0353409 A1* 12/2014 Kim ..... F02M 51/066 239/585.5
2015/0060576 A1* 3/2015 Nonoyama ..... F02M 63/0029 239/585.4

* cited by examiner

*Primary Examiner* — Arthur O Hall
*Assistant Examiner* — Chee-Chong Lee
(74) *Attorney, Agent, or Firm* — Nixon & Vanderhye PC

(57) ABSTRACT

A fuel injector includes a valve body moved together with a movable core and opening an injection port, and an elastic-force applying portion being elastically deformable according to a movement of the valve body to apply an elastic force to the valve body in a valve-closing direction. An elastic coefficient of the elastic-force applying portion is set to meet a condition that Ffc−Ffo≤L×K. In this case, a fuel-pressure valve-closing force of when the valve body is closed is referred to as Ffc, and the fuel-pressure valve-closing force of when the valve body is completely opened is referred to as Ffo. A movement distance of the valve body from a time point that the valve body is closed to a time point that the valve body is completely opened is referred to as L. The elastic coefficient is referred to as K.

19 Claims, 7 Drawing Sheets

FUEL INJECTOR AND FUEL INJECTION DEVICE USING THE SAME

CROSS REFERENCE TO RELATED APPLICATION

This application is based on Japanese Patent Application No. 2013-004156 filed on Jan. 14, 2013, the disclosure of which is incorporated herein by reference.

TECHNICAL FIELD

The present disclosure relates to a fuel injector that is opened or closed by an electromagnetic force, and a fuel injection device using the fuel injector.

BACKGROUND

JP-2011-214536A (US 2013/0087639 A1) discloses a fuel injector that includes a stator core generating an electromagnetic force by energizing a coil, a movable core moved by the electromagnetic force, and a valve body that is moved together with the movable core and opens an injection port. An elastic force of a spring and a fuel pressure are applied to the valve body in a valve-closing direction. When an attractive force (valve-opening force) according to an energization of the coil becomes greater than a closing force corresponding to the elastic force and the fuel pressure, the valve body starts a valve-opening operation.

When the coil is energized to open the valve body, the movable core is moved to and collides with the stator core. When a colliding speed is high, the movable core may rebound from the stator core. In this case, a wave causes at a ti-q line representing a relationship between an energization time ti of the coil and an injection amount q, and a variation in the injection amount is generated. Further, a damage of the movable core or the stator core may occur.

SUMMARY

The object of the present disclosure is to provide a fuel injector that can slow down a colliding speed of a movable core, and a fuel injection device using the fuel injector.

According to an aspect of the present disclosure, a fuel injector includes a coil, a stator core, a movable core, a valve body, and an elastic-force applying portion.

The coil generates a magnetic flux when is energized. The stator core generates a part of a magnetic circuit as a passage of the magnetic flux, and generates an electromagnetic force. The movable core is moved by the electromagnetic force. The valve body is moved together with the movable core, and opens an injection port. The elastic-force applying portion is elastically deformable according to a movement of the valve body to apply an elastic force to the valve body in a valve-closing direction.

An elastic coefficient of the elastic-force applying portion is set to meet a condition that $Ffc-Ffo \leq L \times K$. In this case, among fuel-pressure valve-closing forces applied to the valve body in the valve-closing direction by a fuel pressure, the fuel-pressure valve-closing force of when the valve body is closed is referred to as Ffc, and the fuel-pressure valve-closing force of when the valve body is moved to a position where the valve body is completely opened is referred to as Ffo. A movement distance of the valve body from a time point that the valve body is closed to a time point that the valve body is completely opened is referred to as L. The elastic coefficient is referred to as K.

Therefore, a bounce of the movable core is restricted, the variation of the injection amount can be reduced, and the damage of the movable core and the stator core can be restricted.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
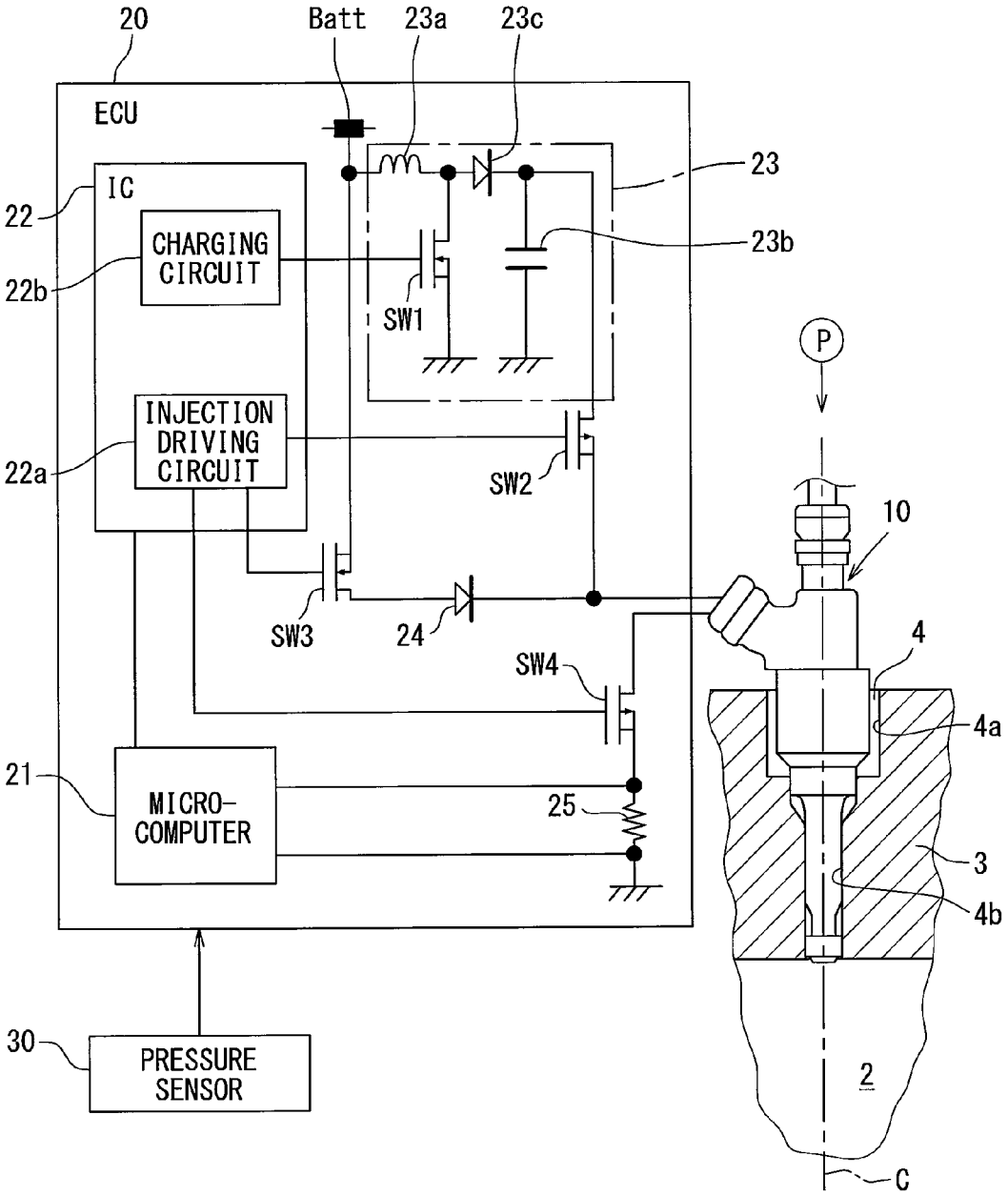
FIG. 1 is a diagram showing a fuel injection device according to a first embodiment of the present disclosure.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

Hereafter, embodiments of the present disclosure will be described with reference to drawings.

First Embodiment

As shown in FIG. 1, a fuel injector 10 is mounted on an internal combustion engine of an ignition type, and directly injects fuel into a combustion chamber 2 of the internal combustion engine. For example, the internal combustion engine may be a gasoline engine. Specifically, an attachment hole 4 for the fuel injector 10 to be inserted into is axially provided in a cylinder head 3 along an axis line C of a cylinder. The fuel supplied to the fuel injector 10 is pumped by a fuel pump P that is driven by the internal combustion engine.

Figure 2:
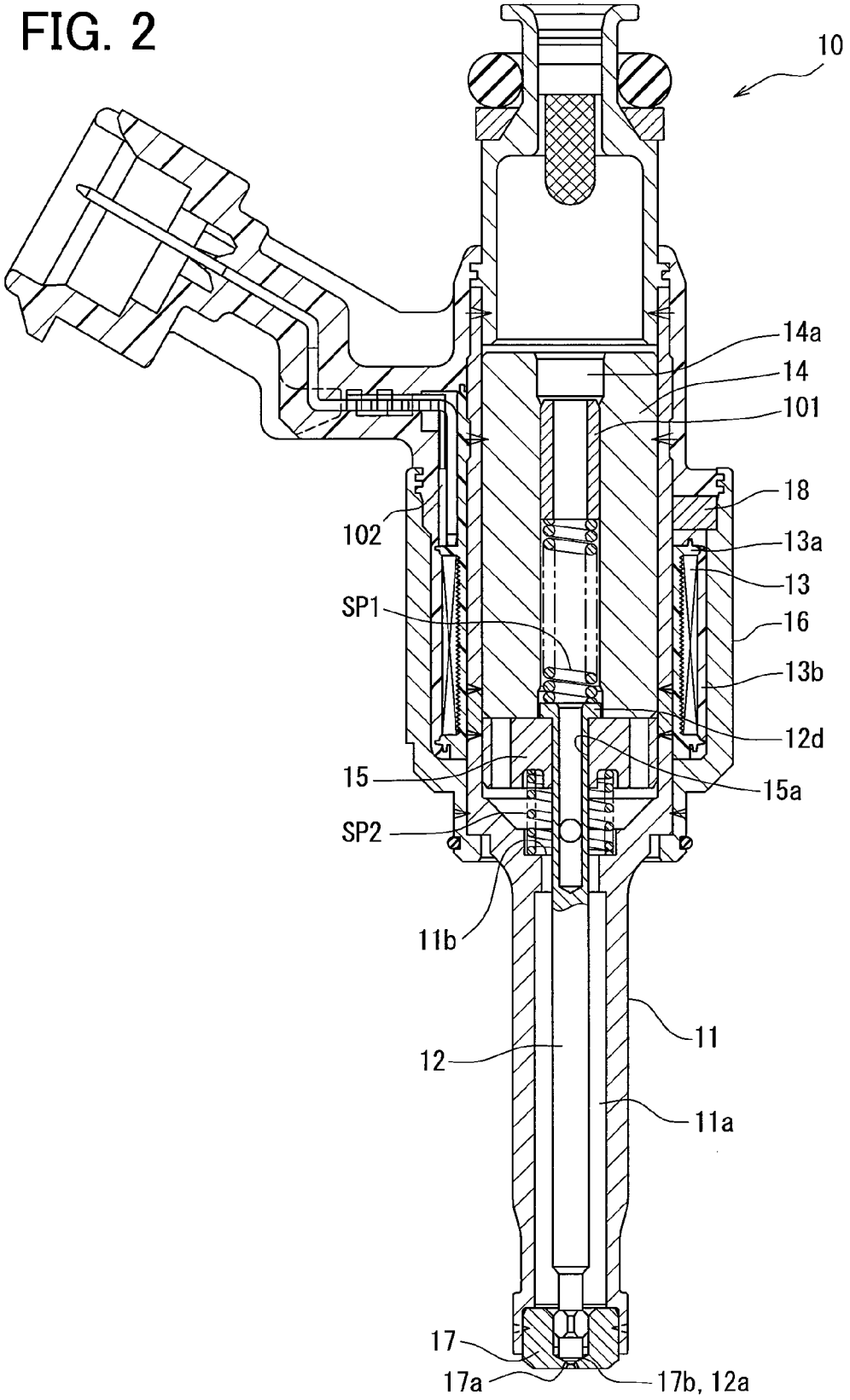
FIG. 2 is a sectional view showing an outline of the fuel injector according to the first embodiment.

As shown in FIG. 2, the fuel injector 10 includes a body 11, a valve body 12, a first coil 13, a stator core 14, a movable core 15, and a housing 16. The body 11 is made of a magnetic metal material, and includes a fuel passage 11*a*. The body 11 forms a seated surface 17*b* and an injection port 17*a*. The valve body 12 abuts on or separates from the seated surface 17*b*. The fuel is injected through the injection port 17*a*.

Figure 3:
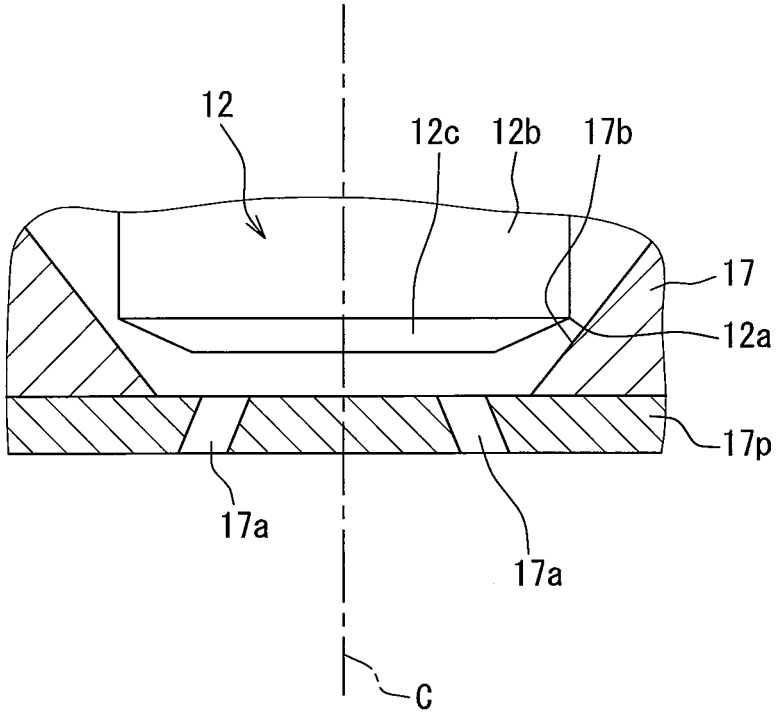
FIG. 3 is an enlarged view of FIG. 2, and shows a sectional view of a seating surface of a valve body.

As shown in FIG. 3, the body 11 further includes an injection-port body 17 having the seated surface 17*b*, and an injection-port plate 17*p* forming the injection port 17*a*. A part of the valve body 12 abutting on the seated surface 17*b* is referred to as a seating surface 12*a*. Specifically, the valve body 12 includes a main body 12*b* and an end part 12*c*, and a border therebetween functions as the seating surface 12*a*. The main body 12*b* is cylinder-shaped and extends in a direction along the axis line C. The end part 12*c* is a substantially truncated conical shape and extends from an end part of the main body 12*b* close to the injection port 17*a* toward the injection port 17*a*. Therefore, a corner that is the border between the main body 12*b* and the end part 12*c* corresponds to the seating surface 12*a* surrounding the axis line C. In this case, the seating surface 12*a* is ring-shaped. In other words, the seating surface 12*a* is provided at an outer peripheral surface of the valve body 12.

When the valve body 12 is closed to make the seating surface 12*a* abut on the seated surface 17*b*, a fuel injection from the injection port 17*a* is stopped. When the valve body 12 is opened (lifted up) to make the seating surface 12*a* separate from the seated surface 17*b*, the fuel is injected from the injection port 17*a*.

The first coil 13 is configured by winding a bobbin 13*a* made of resin. The first coil 13 is sealed by the bobbin 13*a* and a resin member 13*b*. Thus, a coil body which is cylinder-shaped is constructed of the first coil 13, the bobbin 13*a* and the resin member 13*b*.

The stator core 14 is cylinder-shaped using a magnetic metal material. The stator core 14 has a fuel passage 14*a*. The stator core 14 is disposed on an inner peripheral surface of the body 11, and the bobbin 13*a* is disposed on an outer peripheral surface of the body 11. The housing 16 covers an outer peripheral surface of the resin member 13*b*. The housing 16 is cylinder-shaped using a magnetic metal material. A cover member 18 made of a magnetic metal material is placed at an opening end portion of the housing 16. Thus, the coil body is surrounded by the body 11, the housing 16 and the cover member 18.

The movable core 15 is disc-shaped using a magnetic metal material, and is disposed on the inner peripheral surface of the body 11. The body 11, the valve body 12, the coil body, the stator core 14, the movable core 15, and the housing 16 are arranged so that each axis of them is placed in the same direction. The movable core 15 is placed at a position between the injection port 17*a* and the stator core 14. When the first coil 13 is deenergized, a predetermined gap between the movable core 15 and the stator core 14 is generated.

When the first coil 13 is energized to generate an electromagnetic attractive-force at the stator core 14, the movable core 15 is moved towards the stator core 14 by the electromagnetic attractive-force. The electromagnetic attractive-force corresponds to an electromagnetic force. Therefore, the valve body 12 cancels an elastic force of a main spring SP1 and a fuel-pressure valve-closing force and is lifted up (valve-opening operation). When the first coil 13 is deenergized, the valve body 12 is moved together with the movable core 15 by the elastic force of the main spring SP1 (valve-closing operation).

Figure 4:
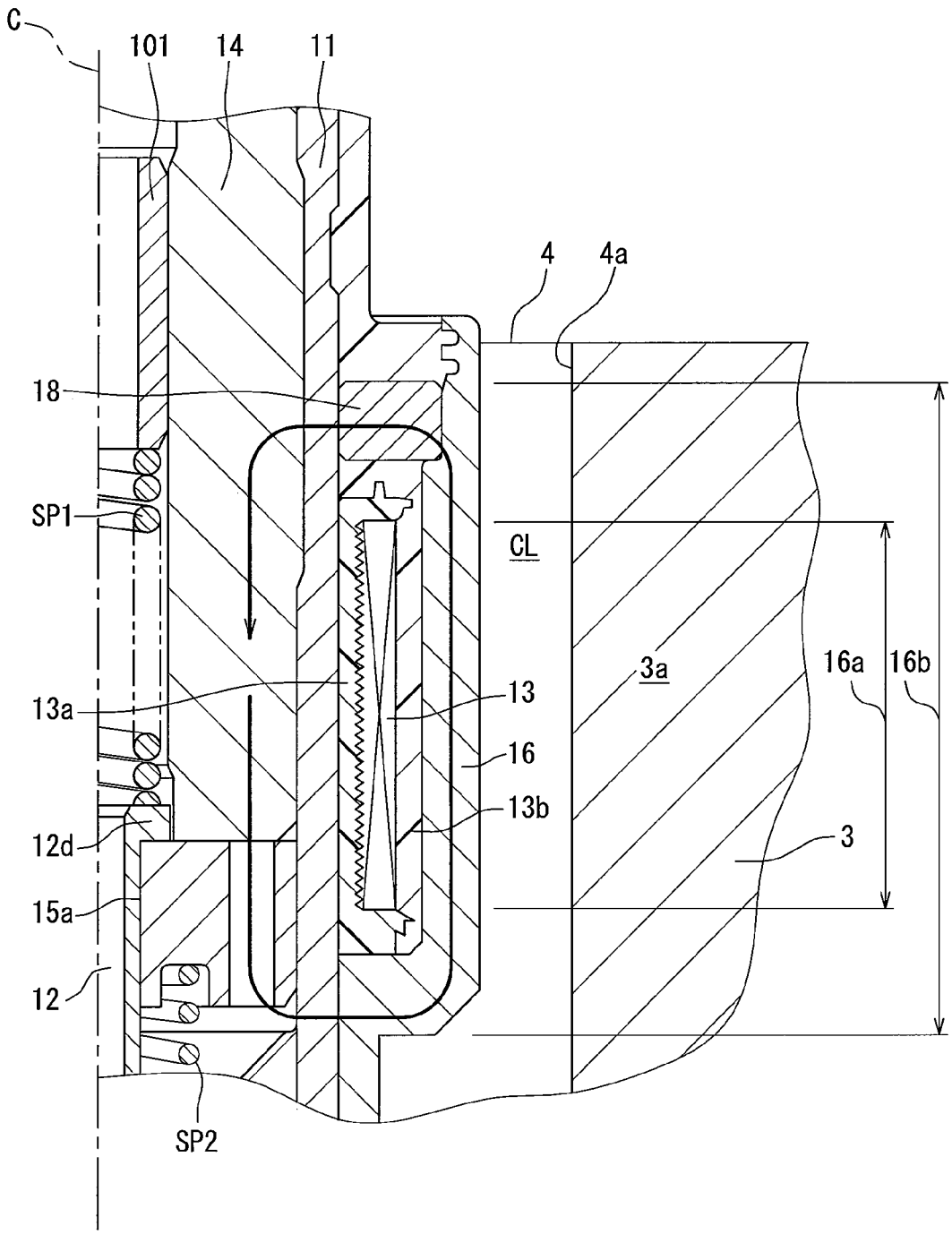
FIG. 4 is another enlarged view of FIG. 2, and shows a sectional view of a magnetic circuit.

FIG. 4 is an enlarged view of FIG. 2, and shows an attachment state of the fuel injector 10 inserted into the attachment hole 4 of the cylinder head 3. The body 11, the housing 16, the cover member 18, and the stator core 14 are made of a magnetic material, and generate a magnetic circuit as a passage of a magnetic flux. The magnetic is generated by energizing the first coil 13. That is, as an arrow shown in FIG. 4, the magnetic flux flows through the magnetic circuit.

A portion of the housing 16 which accommodates the first coil 13 is referred to as a coil portion 16*a*. A portion of the housing 16 which forms the magnetic circuit is referred to as a magnetic circuit portion 16*b*. In other words, a position of a first end surface of the cover member 18 farther from the injection port 17*a* than the second end surface of the cover member 18 in an inserting direction is an edge of the magnetic circuit portion 16*b*. As shown in FIG. 4, the entire of the coil portion 16*a* and the entire of the magnetic circuit portion 16*b* are surrounded over the whole periphery by a first inner peripheral surface 4*a* of the attachment hole 4 in the inserting direction. A portion of the cylinder head 3 which surrounds over the whole periphery of the magnetic circuit corresponds to a conductive ring 3*a*. According to the present embodiment, the conductive ring 3*a* may correspond to a predetermined position of the internal combustion engine.

As shown in FIG. 1, a second inner peripheral surface 4*b* of the attachment hole 4 contacts an outer peripheral surface of a portion of the body 11. In this case, the portion of the body 11 is placed between the injection port 17*a* and the housing 16. As shown in FIG. 4, a clearance CL is formed between the outer peripheral surface of the housing 16 and the first inner peripheral surface of the attachment hole 4. That is, the outer peripheral surface of the magnetic circuit portion 16*b* and the first inner peripheral surface of the attachment hole 4 are opposite to each other with the clearance CL.

As shown in FIG. 2, the movable core 15 forms a through hole 15*a*. The valve body 12 is inserted into the through hole 15*a* to be slidable relative to the movable core 15. The valve body 12 includes a locking portion 12*d* at an end part opposite to the injection port 17*a*. When the movable core 15 is moved towards the stator core 14, since the locking portion 12*d* locks the movable core 15, the valve body 12 is moved together with the movable core 15 to execute the valve-opening operation. Even when the movable core 15 contacts the stator core 14, the valve body 12 is slidable relative to the movable core 15 to be lifted up.

The main spring SP1 is arranged at the end part of the valve body 12 opposite to the injection port 17*a*. A sub spring SP2 is arranged at an end part of the movable core 15 close to the injection port 17*a*. The main spring SP1 and the sub spring SP2 are coil-shaped and are elastically deformable in the direction along the axis line C. The elastic force of the main spring SP1 corresponding to a main elastic force Fs1 is applied to the valve body 12 in a valve-closing direction as a reactive force of an adjusting pipe 101. An elastic force of the sub spring SP2 corresponding to a sub elastic force Fs2 is applied to the movable core 15 in a pressing direction as a reactive force of a concave portion 11*b* of the body 11. The pressing direction is a direction where the movable core 15 is pressed towards the locking portion 12*d*. The main spring SP1 and the sub spring SP2 are elastically deformable according to a movement of the valve body 12 to apply an elastic force to the valve body 12 in the valve-closing direction.

The valve body 12 is provided between the main spring SP1 and the seated surface 17*b*. The movable core 15 is provided between the sub spring SP2 and the locking portion 12*d*. The sub elastic force Fs2 of the sub spring SP2 is transmitted to the locking portion 12*d* via the movable core 15 and is applied to the valve body 12 in a valve-opening direction. Therefore, a computed elastic force Fs that is subtracting the sub elastic force Fs2 from the main elastic force Fs1 is applied to the valve body 12 in the valve-closing direction. The main spring SP1 and the sub spring SP2 correspond to an elastic-force applying portion.

Figure 5:
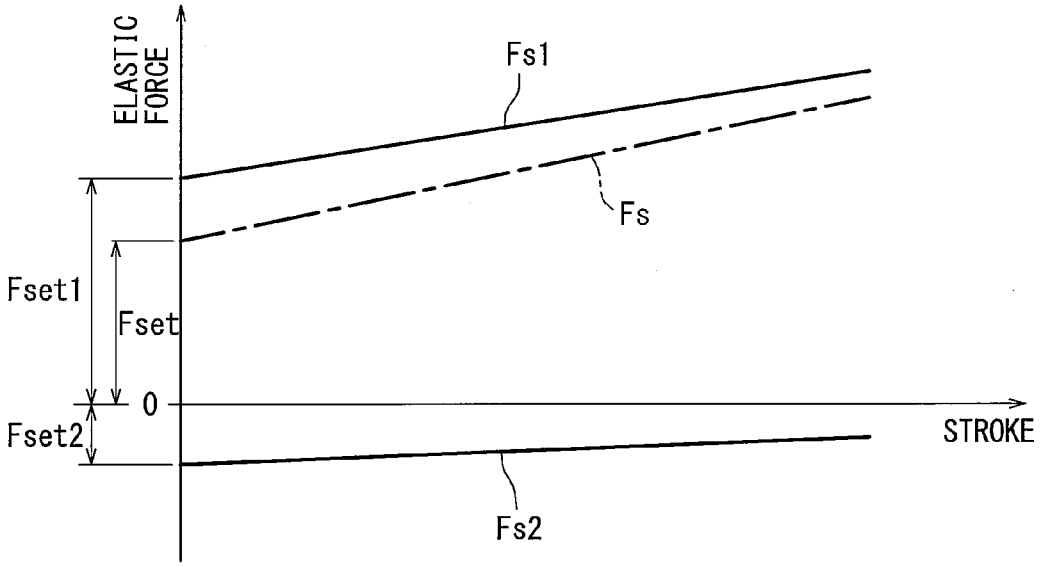
FIG. 5 is a graph showing a relationship between elastic forces Fs1, Fs2 and a stroke, according to the first embodiment.

A horizontal axis shown in FIG. 5 represents a valve-opening movement amount. The valve-opening movement amount corresponds to a stroke. When the valve body 12 is closed, the stroke is zero. A vertical axis shown in FIG. 5 represents an elastic force applied to the valve body 12. The elastic force that is greater than zero represents a valve-closing force, and the elastic force that is less than zero represents a valve-opening force. When the valve body 12 is lifted up, a pressing amount of the main spring SP1 corresponding to an elastic deformation amount is increased, and a solid line represent the main elastic force Fs1 shown in FIG. 5 is increased.

In this case, a pressing amount of the sub spring SP2 corresponding to an elastic deformation amount is decreased, and a solid line representing the sub elastic force Fs2 shown in FIG. 5 is decreased. A dashed-dotted line shown in FIG. 5 represents the computed elastic force Fs that is a vector sum of the main elastic force Fs1 and the sub elastic force Fs2.

$$Fs=Fs1+Fs2$$

Since a magnitude of the main elastic force Fs1 is greater than a magnitude of the sub elastic force Fs2, the computed elastic force Fs is applied to the valve body 12 in the valve-closing direction. Further, the computed elastic force Fs is increased in accordance with an increase in stroke.

The computed elastic force Fs corresponds to the elastic force of the elastic-force applying portion. Therefore, an elastic coefficient K of the computed elastic force Fs is a value combined an elastic coefficient K1 of the main spring SP1 with an elastic coefficient K2 of the sub spring SP2. In accordance with the increase in stroke, the elastic coefficient K1 of the main spring SP1 is increased, and the elastic coefficient K2 of the sub spring SP2 is decreased. Therefore, the elastic coefficient K is increased in accordance with an increase in the elastic coefficient K1, and is increased in accordance with a decrease in the elastic coefficient K2.

As shown in FIG. 5, when the valve body 12 is closed, the main elastic force Fs1 corresponding to a main setting load Fset1 is greater than the sub elastic force Fs2 corresponding to a sub setting load Fset2. In this case, the computed elastic force Fs is less than the main setting load Fset1. As shown in FIGS. 2 and 4, the adjusting pipe 101 is provided in the stator core 14. The main setting load Fset1 is adjustable according to an attachment position of the adjusting pipe 101.

Further, a terminal 102 shown in FIG. 2 supplies power to the first coil 13. As the arrow shown in FIG. 4, the magnetic circuit is surrounded by the conductive ring 3*a*. When a magnetic flux is generated in the magnetic circuit according to an energization of the first coil 13, thereby an eddy current is generated at a conductor such as the cylinder head 3. The eddy current flows in a direction along the periphery of the body 11.

Figure 6:
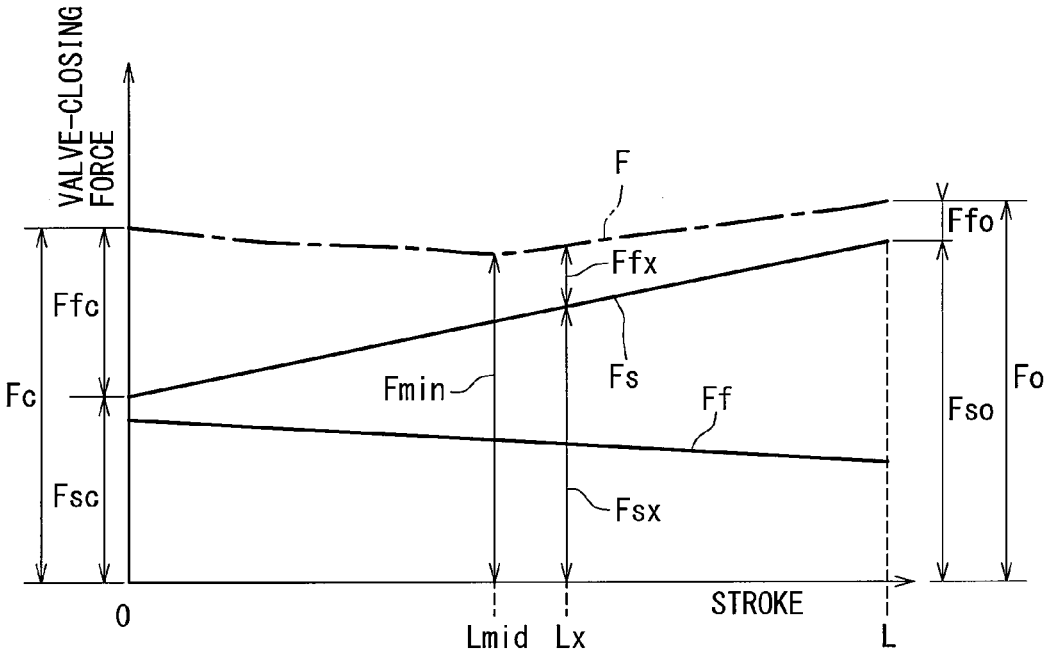
FIG. 6 is a graph showing a relationship between a fuel-pressure valve-closing force applied to a fuel injector and the stroke, according to the first embodiment.

A horizontal axis shown in FIG. 6 represents the stroke. A vertical axis shown in FIG. 6 represents the valve-closing force applied to the valve body 12. A solid line Fs represents the computed elastic force Fs, and a solid line Ff represents the fuel-pressure valve-closing force Ff that presses the valve body 12 in the valve-closing direction by a fuel pressure.

A fuel pressing force applied to the valve body 12 in the valve-closing direction is greater than the fuel pressing force applied to the valve body 12 in the valve-opening direction. Therefore, the valve body 12 is pressed in the valve-closing direction by the fuel pressure. When the valve body 12 is closed, the end part 12*c* is not pressed by the fuel pressure. When the valve body 12 starts to be opened, a fuel pressure pressed on the end part 12*c* is gradually increased, and the fuel pressing force applied to the end part 12*c* in the valve-opening direction is increased. Therefore, the fuel-pressure valve-closing force Ff is decreased. As the above description, when the valve body 12 is closed, the fuel-pressure valve-closing force is the maximum. Then, the fuel-pressure valve-closing force is gradually decreased in accordance with an increase in valve-opening movement amount of the valve body 12.

As shown in FIG. 6, the dashed-dotted line represents a computed valve-closing force F that is a vector sum of the computed elastic force Fs and the fuel-pressure valve-closing force Ff. When the valve body 12 is closed, the fuel-pressure valve-closing force Ff is referred to as the fuel-pressure valve-closing force Ffc, and the computed elastic force Fs is referred to as the computed elastic force Fsc. When the valve body 12 is completely opened, the fuel-pressure valve-closing force Ff is referred to as the fuel-pressure valve-closing force Ffo, and the computed elastic force Fs is referred to as the computed elastic force Fso. A movement distance of the valve body 12 from a time point that the valve body 12 is closed to a time point that the valve body 12 is completely opened is referred to as the movement distance L. A movement distance of the valve body 12 from the time point that the valve body 12 is closed to a time point that the valve body 12 is moved to a predetermined position is referred to as the movement distance Lx. The fuel-pressure valve-closing force of when the valve body 12 is moved to the predetermined position is referred to as the fuel-pressure valve-closing force Ffx.

The elastic coefficients K1 and K2 are set according to the following conditions. Condition (i): $Ffc-Ffo \leq L \times K$. Condition (ii): $F=Ffx+Lx \times K$. In this case, the computed valve-closing force F is continuously increased during a time period from a time point that the movement distance becomes the movement distance Lx to a time point that the movement distance becomes the movement distance L. Condition (iii): $Fsc \geq Ffc$.

The fuel-pressure valve-closing force Ff varies according to the fuel pressure (supply pressure) of a fuel supplied from the fuel pump P to the fuel injector 10. Since the fuel pump P is driven by the internal combustion engine, the fuel-pressure valve-closing force Ff varies according to a rotational speed Ne of the internal combustion engine. When the internal combustion engine is running at an idle operation, the elastic coefficients K1 and K2 are set to meet the conditions (i) and (ii). When the internal combustion engine is running at a high-speed operation that the rotational speed Ne is greater than or equal to a predetermined speed, the elastic coefficients K1 and K2 are set not to meet the conditions (i) and (ii).

As shown in FIG. 1, an electronic control unit (ECU) 20 corresponding to a control portion includes a microcomputer 21, an integrated circuit (IC) 22, a boost circuit 23, and switching elements SW2, SW3, and SW4. The control portion controls an injection state of fuel injected from the injection port 17*a* by controlling a current (coil current) flowing through the first coil 13.

Figure 7:
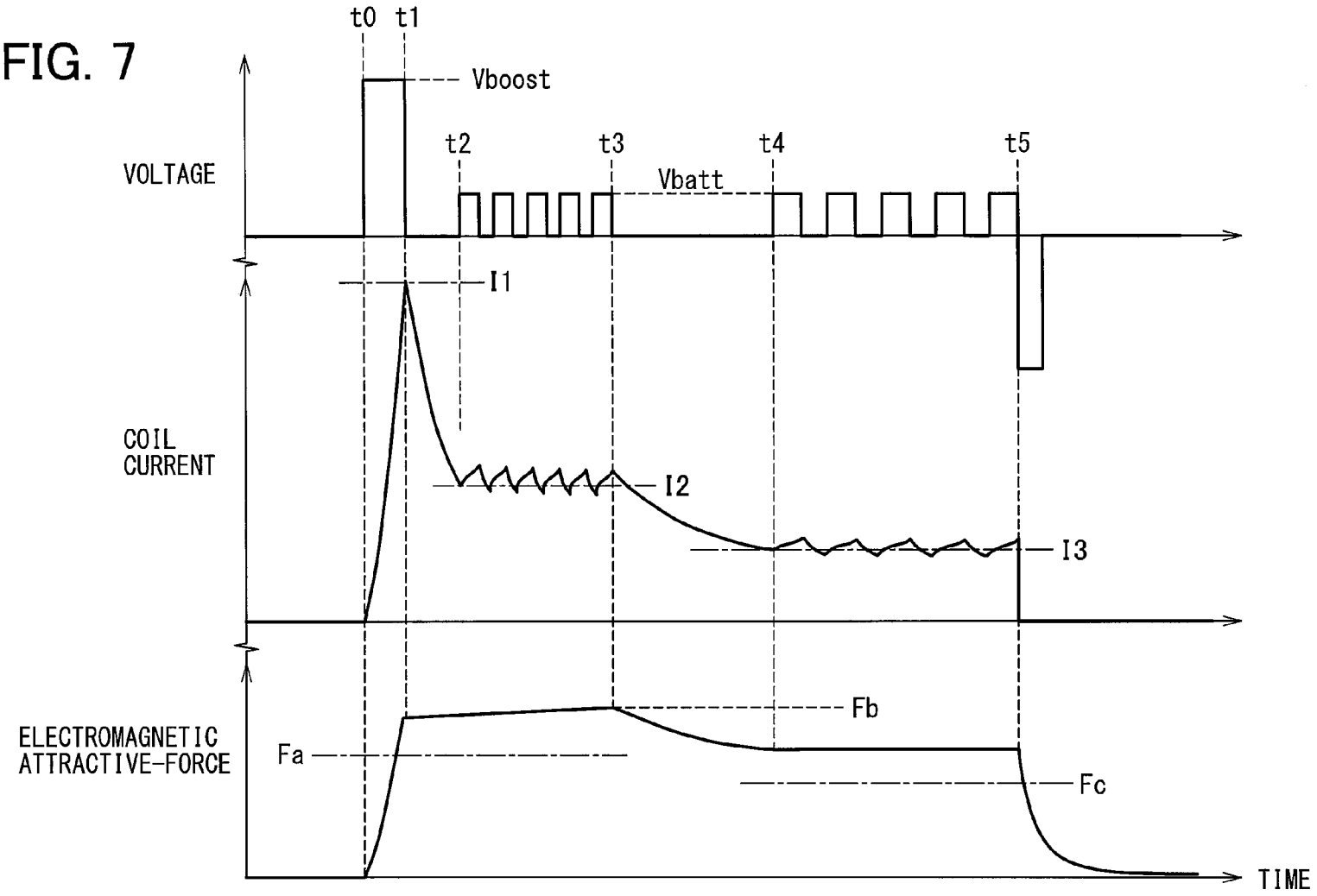
FIG. 7 is a graph showing a relationship between an applied voltage, a coil current, an electromagnetic attractive-force, and time, when an injection control is executed according to the first embodiment.

The microcomputer 21 includes a central processing unit, a nonvolatile memory (ROM), and a volatile memory (RAM). The microcomputer 21 computes a target injection amount and a target injection-start time, based on a load of the internal combustion engine and the rotational speed of the internal combustion engine. Further, an injection property representing a relationship between an energization time period Ti and an injection amount q is predefined by test. Therefore, the microcomputer 21 controls the energization time period Ti according to the injection property to control the injection amount q. As shown in FIG. 7, the first coil 13 is energized at a time point (energization start time point) t1, and is deenergized at a time point (energization stop time point) t5.

The IC 22 includes an injection driving circuit 22*a* and a charging circuit 22*b*. The injection driving circuit 22*a* controls the switching elements SW2, SW3, and SW4. The charging circuit 22*b* controls the boost circuit 23. The injection driving circuit 22*a* and the charging circuit 22*b* are operated according to an injection command signal outputted from the microcomputer 21. The injection command signal, which is a signal for controlling an energizing state of the first coil 13, is set by the microcomputer 21 based on the target injection amount, the target injection start time point, and a coil circuit value I. The injection command signal includes an injection signal, a boost signal, and a battery signal.

The boost circuit 23 includes a second coil 23*a*, a condenser 23*b*, a first diode 23*c*, and a first switching element SW1. When the charging circuit 22*b* repeatedly turns on or turns off the first switching element SW1, a battery voltage applied from a battery terminal Batt is boosted by the second coil 23*a*, and is accumulated in the condenser 23*b*. In this case, the battery voltage after being boosted and accumulated corresponds to a boost voltage.

When the injection driving circuit 22*a* turns on both a second switching element SW2 and a fourth switching element SW4, the boost voltage is applied to the first coil 13. When the injection driving circuit 22*a* turns on both a third switching element SW3 and the fourth switching element SW4, the battery voltage is applied to the first coil 13. When the injection driving circuit 22*a* turns off the switching elements SW2, SW3 and SW4, no voltage is applied to the first coil 13. When the second switching element SW2 is turned on, a second diode 24 shown in FIG. 1 is for preventing the boost voltage from being applied to the third switching element SW3.

A shunt resistor 25 is provided to detect a current flowing through the fourth switching element SW4, that is, the shunt resistor 25 is provided to detect the coil current. The microcomputer 21 computes the coil current value I based on a voltage decreasing amount generated at the shunt resistor 25.

Hereafter, an electromagnetic attractive-force (valve-opening force) generated by the coil current will be described.

The electromagnetic attractive-force is increased in accordance with an increase in magnetomotive force (ampere turn AT) generated in the stator core 14. Specifically, in a condition where a number of turns of the first coil 13 is fixed, the electromagnetic attractive-force is increased in accordance with an increase in ampere turn AT. An increasing time period is necessary for the attractive force to be saturated and become the maximum since the first coil 13 is energized. According to the embodiment, the maximum value of the electromagnetic attractive-force is referred to as a static attractive-force Fb.

In addition, the electromagnetic attractive-force required for starting to open the valve body 12 is referred to as a required valve-opening force Fa. The required valve-opening force is increased in accordance with an increase in pressure of a fuel supplied to the fuel injector 10. Further, the required valve-opening force may be increased according to various conditions such as an increase in viscosity of fuel. The maximum value of the required valve-opening force is referred to as the required valve-opening force Fa.

FIG. 7 shows a waveform of a voltage applied to the first coil 13 in a case where the fuel injection is executed once. At a time point t1, the boost voltage Vboost is applied to the first coil 13 by the injection command signal, so that the first coil 13 is started to be energized. As shown in FIG. 7, the coil current is increased to a first target value I1 since the first time point t1. The energization is turned off at the time point t1 that the coil current value I reaches the first target value I1 The coil current is increased to the first target value I1 by applying the boost voltage Vboost to the first coil 13, according to the energization for the first time. In this case, the microcomputer 21 corresponds to an increasing control portion.

Next, the first coil 13 is applied by the battery voltage Vbatt to hold the coil current to a second target value I2 that is less than the first target value I1. Specifically, a duty control is executed so that a difference between the coil current value I and the second target value I2 is in a predetermined range. In the duty control, an on-off energization of the battery voltage Vbatt is repeated since a time point t2 to hold an average value of the coil current to the second target value I2. In this case, the microcomputer 21 corresponds to a pick-up control portion. The second target value I2 is set to a value so that the static attractive-force Fb is greater than or equal to the required valve-opening force Fa.

Next, the first coil 13 is applied by the battery voltage Vbatt to hold the coil current to a third target value I3 that is less than the second target value I2. Specifically, a duty control is executed so that a difference between the coil current value I and the third target value I3 is in a predetermined range. In the duty control, an on-off energization of the battery voltage Vbatt is repeated since a time point t4 to hold an average value of the coil current to the third target value I3. In this case, the microcomputer 21 corresponds to a hold control portion.

As shown in FIG. 7, the electromagnetic attractive-force is continuously increased during a time period from an increase start time point t0 to a time point t3 that a pick-up control is completed. An increasing rate of the electromagnetic attractive-force during a pick-up control time period from the time point t1 to the time point t3 is less than the increasing rate of the electromagnetic attractive-force during an increase control time period from the time point t0 to the time point t1. The first target value I1, the second target value I2, and the pick-up control time period are set so that the attractive force is greater than the required valve-opening force Fa during the time period from the increase start time point t0 to the time point t3.

The attractive force is held to a predetermined value during a hold control time period from the time point t4 to the time point t5. The third target value I3 is set so that a valve-opening hold-force Fc is less than the predetermined value. The valve-opening hold-force Fc is necessary to hold the valve body 12 to open. The valve-opening hold-force Fc is less than the required valve-opening force Fa.

The injection signal of the injection command signal is a pulse signal dictating to the energization time period Ti. A pulse-on time point of the injection signal is set to the time point t0 by an injection delay time earlier than a target energization start time point. A pulse-off time point of the injection signal is set to the energization stop time point t5 after the energization time period Ti has elapsed since the time point t1. The fourth switching element SW4 is controlled by the injection signal.

The boost signal of the injection command signal is a pulse signal dictating to an energization state of the boost voltage Vboost. The boost signal has a pulse-on time point as the same as the pulse-on time point of the injection signal. Next, the boost signal is repeatedly turned on or off until the coil current value I reaches the first target value I1. The second switching member SW2 is controlled by the boost signal. The boost voltage Vboost is applied to the first coil 13 during the increase control time period.

The battery signal of the injection command signal is turned on at the time point t2. In this case, the time point t2 corresponds to a pick-up control start time point. Next, the battery signal is repeatedly turned on or off to execute a feedback control during a time period that a predetermined time has elapsed since the energization start time point. In this case, the feedback control holds the coil current value I to the second target value I2. Next, the battery signal is repeatedly turned on or off to execute a feedback control until the injection signal is turned off. In this case, the feedback control holds the coil current value I to the third target value I3. The third switching element SW3 is controlled by the battery signal.

A pressure (fuel pressure) Pc of the fuel supplied to the fuel injector 10 is detected by a pressure sensor 30 shown in FIG. 1. The ECU 20 determines whether to execute the pick-up control according to the fuel pressure Pc. For example, when the fuel pressure Pc is greater than or equal to a predetermined threshold Pth, the pick-up control is permitted. When the fuel pressure Pc is less than the predetermined threshold Pth, the hold control is executed instead of the pick-up control, after the increasing control is executed.

According to the above description, the fuel injector has the following features. Further, effects of the features will be described.

(a) The elastic coefficient K corresponding to the elastic coefficients K1 and K2 is set to meet condition (1) that $Ffc-Ffo \leq L \times K$.

As shown in FIG. 6, the left side (Ffc−Ffo) of condition (i) represents a decreased amount of the fuel-pressure valve-closing force from the time point that the valve body 12 is closed to the time point that the valve body 12 is completely opened, and the right side (L×K) of condition (i) represents an increased amount of the elastic force from the time point that the valve body 12 is closed to the time point that the valve body 12 is completely opened. The increased amount of the elastic force is greater than or equal to the decreased amount of the fuel-pressure valve-closing force. Since the increased amount of the elastic force compensates for the decreased amount of the fuel-pressure valve-closing force, it can be restricted that a total valve-closing force Fo is decreased in accordance with a decrease in fuel-pressure valve-closing force Ff when the movable core 15 collides with the stator core 14. The total valve-closing force Fo is a sum of the computed elastic force Fso and the fuel-pressure valve-closing force Ffo.

It can be restricted that the movable core 15 rebounds from the stator core 14 when the movable core 15 collides with the stator core 14. The injection amount q is prevented from shifting away from the injection property, and a variation of the injection amount q can be reduced. Further, since a decreasing of the total valve-closing force Fo can be restricted, a damage of the movable core 15 and the stator core 14 can be restricted.

(b) The elastic coefficient K corresponding to the elastic coefficients K1 and K2 is set to meet condition (ii) that the computed valve-closing force F is continuously increased during a time period from a time point that the movement distance becomes Lx to a time point that the movement distance becomes L. Since the computed valve-closing force F corresponding to a sum of the fuel-pressure valve-closing force Ff and the elastic force Fs is continuously increased until the valve body 12 is completely opened, a colliding speed of the movable core 15 can be reduced. Therefore, a bounce of the movable core is restricted, the variation of the injection amount can be reduced, and the damage of the movable core and the stator core can be restricted.

(c) When the internal combustion engine is running at the idle operation, the elastic coefficient K corresponding to the elastic coefficients K1 and K2 is set to meet conditions (i) and (ii).

The fuel-pressure valve-closing force Ff varies according to the supply pressure. Further, since the fuel pump P is driven by the internal combustion engine, the fuel-pressure valve-closing force Ff varies according to the rotational speed Ne of the internal combustion engine. The decreased amount of the fuel-pressure valve-closing force is decreased in accordance with a decrease in rotational speed Ne.

Since the elastic coefficients K1 and K2 are set to meet conditions (i) and (ii) in a case where the decreased amount of the fuel-pressure valve-closing force is the minimum at the idle operation, the colliding speed of the movable core is reduced. In addition, the above effect is not limited to the idle operation.

It is necessary to lower a colliding sound of the movable core at the idle operation. Since the above effect is achieved, the colliding sound can be lowered.

It is necessary to accurately control the injection amount in a micro-injection area of the injection property in a case where the injection amount is small. Therefore, since the variation of the injection amount can be reduced, the injection amount can be accurately controlled at the micro-injection area.

(d) When the internal combustion engine is running at the high-speed operation that the rotational speed Ne is greater than or equal to the predetermined speed, the elastic coefficient K corresponding to the elastic coefficients K1 and K2 is set not to meet the conditions (i) and (ii).

Since one combustion cycle at the high-speed operation is shorter than the one combustion cycle at other operations, a time period for injecting is shorter at the high-speed operation. Therefore, it is preferable that a valve-opening speed of the valve body 12 is increased. Thus, it is preferable that the elastic coefficient K is decreased to decrease the computed elastic force Fs, and thereby decreasing the computed valve-closing force F. Since the elastic coefficient K is set not to meet conditions (i) and (ii) at the high-speed operation, the valve-opening speed can be increased at the high-speed operation. In other words, it is priority that the colliding speed of the movable core 15 is decreased at the idle operation, and the valve-opening speed of the valve body 12 is increased at the high-speed operation.

(e) The elastic coefficient K is set to meet condition (iii) that the computed elastic force Fsc is greater than or equal to the fuel-pressure valve-closing force Ffc. In other words, a setting load corresponding to the computed elastic force Fsc is set to be large. Therefore, a valve-closing delay time period from the time point t5 that the energization is stopped to a time point that the valve body 12 is closed is shortened. Even when the energization time period Ti is the same, the injection amount q becomes smaller. Thus, an area of the injection property corresponding to a full-lift area where the fuel injector 10 can inject at a full-lift state can enlarge to the micro-injection area (micro area). At the full-lift state of the fuel injector 10, the valve body 12 is completely opened.

In the micro area, the stroke of the valve body 12 is small, and a valve-opening amount of the seating surface 12*a* is small. Therefore, the fuel pressure is decreased sharply near the seating surface 12*a*. It is preferable that the full-lift area enlarges to the micro area. When the fuel injector 10 injects at the full-lift state, the full-lift area can be enlarged.

(f) The valve body 12 is assembled to be slidable with respect to the movable core 15. The elastic-force applying portion includes the main spring SP1 and the sub spring SP2. The main spring SP1 is a spring applying the elastic force to the valve body 12 in the valve-closing direction, and is provided to increase the elastic force in the valve-closing direction in accordance with an increase in stroke of the valve body 12. The sub spring SP2 is a spring applying the elastic force to the valve body 12 via the movable core 15 in the valve-opening direction, and is provided to decrease the elastic force in the valve-opening direction in accordance with the increase in stroke of the valve body 12. The elastic coefficient K is a value combined the elastic coefficient K1 of the main spring SP1 with the elastic coefficient K2 of the sub spring SP2.

Since the sub spring SP2 applies the elastic force in the valve-opening direction, and is provided to decrease the elastic force in the valve-opening direction in accordance with the increase in stroke, the elastic coefficient K representing a slope of the dashed-dotted line is greater than the elastic coefficient K1 representing a slope of the solid line Fs1, as shown in FIG. 5.

It is necessary that the elastic coefficient K which meets the conditions (i) and (ii) is greater than the elastic coefficient K which does not meet the conditions (i) and (ii). It is necessary to increase a coil diameter at which a coil spring is wound or a wire diameter of the coil spring, to increase the elastic coefficient K. The coil spring corresponds to the main spring SP1. Since a space in the fuel injector 10 for arranging the main spring SP1 is limited, there is a limit for increasing the elastic coefficient K.

Since the elastic coefficient K is greater than the elastic coefficient K1, even though the elastic coefficient K1 is smaller than the elastic coefficient K1 of when the elastic-force applying portion is constructed only by the main spring SP1, the elastic coefficient K1 can meet the conditions (i) and (ii). Thus, when the space for arranging the main spring SP1 is limited, the elastic coefficient K can be readily increased to meet the conditions (i) and (ii).

(g) The elastic coefficient K1 of the main spring SP1 is greater than the elastic coefficient K2 of the sub spring SP2.

The main setting load Fset1 is adjustable according to the attachment position of the adjusting pipe 101. The sub setting load Fset2 is set by a distance between the concave portion 11*b* of the body 11 and the movable core 15 in an axis direction. In other words, the sub setting load Fset2 is set by a dimension accuracy of the body 11 and a dimension accuracy of the movable core 15. Thus, the main setting load Fset1 can be adjusted more accurately than the sub setting load Fset2.

Since the elastic coefficient K1 is greater than the elastic coefficient K2, the elastic coefficient K1 affects the elastic coefficient K more than the elastic coefficient K2 does. Therefore, the main setting load Fset1 affects a computed setting load Fset more than the sub setting load Fset2 does. In this case, the computed setting load Fset of the elastic-force applying portion is set by the following formula.

$$Fset=Fset1-|Fset2|$$

Since the main setting load Fset1 is accurately adjustable, the computed setting load Fset can be adjusted more accurately than the computed setting load Fset set in a case where the elastic coefficient K1 is less than or equal to the elastic coefficient K2.

(h) The control portion includes the increasing control portion and the pick-up control portion. The increasing control portion applies a voltage to the first coil 13 to increase the coil current to the first target value I1. The pick-up control portion applies a voltage to the first coil 13 to hold the coil current to the second target value I2 that is less than the first target value I1 after the coil current is increased by the increasing control portion. The maximum value of the electromagnetic attractive-force required for starting to open the valve body 12 is referred to as the required valve-opening force Fa, the electromagnetic attractive-force saturated by holding the coil current to the second target value I2 is referred to as the static attractive-force Fb. The second target value I2 is set so that the static attractive-force Fb is greater than or equal to the required valve-opening force Fa.

After the electromagnetic attractive-force is increased by the increasing control, the electromagnetic attractive-force is also increased during the pick-up control time period, and is greater than or equal to the required valve-opening force Fa during the pick-up control time period. Therefore, the valve body 12 can be opened during the pick-up control time period.

Since the elastic coefficient K is set to meet the conditions (i) and (ii), the elastic coefficient K is greater than that of a conventional technology. Therefore, a time period from a time point that the valve body is started to open to a time point that the valve body is completely opened becomes longer. As a result, the coil current becomes excessive during the increasing control time period, and the electromagnetic attractive-force of when the valve body is completely opened becomes excessive. The colliding speed of the movable core 15 may be reduced insufficiently.

Since the valve body can be opened during the pick-up control time period, the increasing control time period is not increased even though the time period from the time point that the valve body is started to open to the time point that the valve body is completely opened becomes longer due to the elastic coefficient K set to meet the conditions (i) and (ii). Thus, it can be restricted that the electromagnetic attractive-force becomes excessive. Further, the colliding speed of the movable core 15 can be reduced sufficiently.

Second Embodiment

Figure 8:
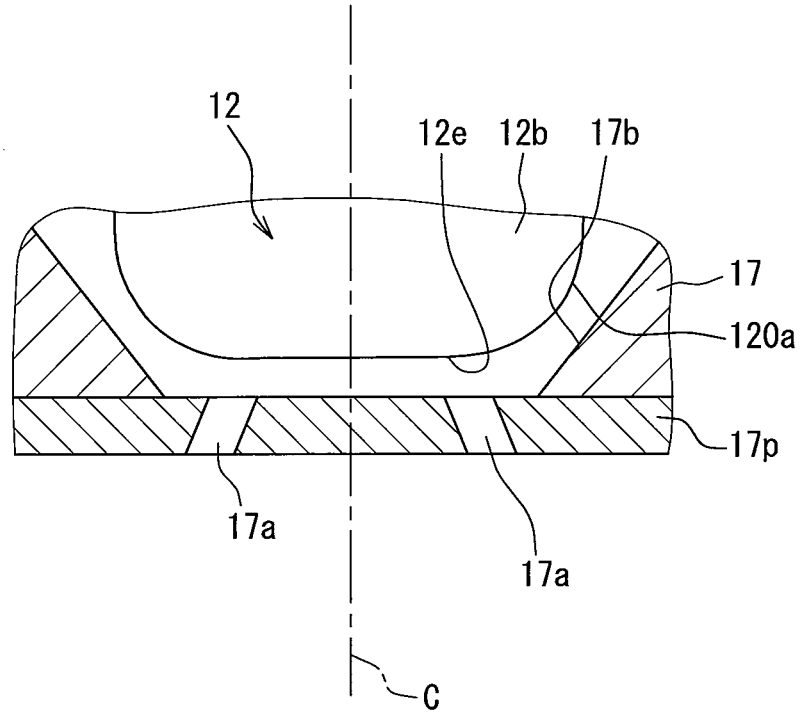
FIG. 8 is a sectional view showing a seating surface of a valve body, according to a second embodiment of the present disclosure.

According to the first embodiment, the border between the main body 12*b* and the end part 12*c* functions as the seating surface 12*a*. According to a second embodiment, as shown in FIG. 8, an end part 12*e* is a substantially spherical shape and extends from the main body 12*b* towards the injection port 17*a*. Further, a part of the end part 12*e* which abuts on the seated surface 17*b* functions as a seating surface 120*a*. In other words, the seating surface 120*a* replaces the seating surface 12*a*. As shown in FIG. 8, the seating surface 120*a* has a curved portion. According to the first embodiment, the seating surface 12*a* has an angled portion.

A ratio of the fuel-pressure valve-closing force Ffo relative to the fuel-pressure valve-closing force Ffc is referred to as a throttle ratio Tr.

$$Tr=Ffo/Ffc$$

Since the fuel-pressure valve-closing force Ffo is decreased in accordance with an increase in the throttle ratio Tr, it can be restricted that the fuel-pressure valve-closing force is gradually decreased when the valve body 12 is lifted up.

Since the seating surface 120*a* has the curved portion, the throttle ratio Tr is less than that of the seating surface 12*a* having the angled portion. When the seating surface 120*a* is used, it can be restricted that the fuel-pressure valve-closing force Ffo becomes smaller and the fuel-pressure valve-closing force is gradually decreased when the valve body 12 is lifted up. Therefore, the elastic coefficient K can be set to a smaller value to meet the conditions (i) and (ii), and it is easy to set the elastic coefficient K to a larger value.

Other Embodiment

The present disclosure is not limited to the above embodiments, and may change as followings. Further, various combinations of the features of the above embodiments are also within the spirit and scope of the present disclosure.

(a) As shown in FIG. 2, in the fuel injector 10, the valve body 12 is assembled to be slidable with respect to the movable core 15, and the elastic-force applying portion includes two springs SP1 and SP2. However, for example, the valve body 12 may be provided to fix to the movable core 15. Alternatively, the elastic-force applying portion only includes the main spring SP1. Further, the sub spring SP2 may be canceled.

(b) According to the first embodiment, the elastic coefficient K is set so that the total valve-closing force Fo of when the valve body 12 is completely opened is greater than a total valve-closing force FFc of when the valve body 12 is closed. However, even though the total valve-closing force Fo is less than or equal to the total valve-closing force FFc, the present disclosure may be used as long as condition (ii) is met. Alternatively, the present disclosure may be used as long as condition (i) is met.

(c) According to the first embodiment, when the coil current is increased to the first target value I1 by the increase control, the coil current is decreased to the second target value I2. However, the coil current may be held to the first target value I1 after the coil current is increased to the first target value I1 by the increase control, and then may be decreased to the third target value I3. In other words, the second target value I2 may be set to a value equal to the first target value I1 in the first embodiment.

While the present disclosure has been described with reference to the embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A fuel injector comprising:

a coil generating a magnetic flux when being energized;

a stator core generating a part of a magnetic circuit as a passage of the magnetic flux, the stator core generating an electromagnetic force;

a movable core moved by the electromagnetic force;

a valve body moved together with the movable core, the valve body opening an injection port; and an elastic-force applying portion being elastically deformable according to a movement of the valve body to apply an elastic force to the valve body in a valve-closing direction, wherein an elastic coefficient of the elastic-force applying portion is set to meet a condition that $Ffc-Ffo \leq L \times K$, wherein among fuel-pressure valve-closing forces applied to the valve body in the valve-closing direction by a fuel pressure, the fuel-pressure valve-closing force of when the valve body is closed is referred to as Ffc, the fuel-pressure valve-closing force of when the valve body is moved to a position where the valve body is completely opened is referred to as Ffo, a movement distance of the valve body from a time point that the valve body is closed to a time point that the valve body is completely opened is referred to as L, and the elastic coefficient is referred to as K.

2. The fuel injector according to claim 1, wherein the elastic coefficient K is set to meet a condition that a value of $(Ffx+Lx \times K)$ is continuously increased during a time period from a time point that the movement distance becomes Lx to a time point that the movement distance becomes L, wherein the fuel-pressure valve-closing force of when the valve body is moved to a predetermined position is referred to as Ffx, and the movement distance of the valve body from the time point that the valve body is closed to a time point that the valve body is moved to the predetermined position is referred to as Lx.

3. The fuel injector for a combustion system that has an internal combustion engine operating according to a combustion of fuel injected from the injection port, and a fuel pump driven by the internal combustion engine and generating the fuel pressure, according to claim 1, wherein the elastic coefficient K is set to meet the condition, when the internal combustion engine is running at an idle operation.

4. The fuel injector according to claim 3, wherein the elastic coefficient K is set not to meet the condition, when the internal combustion engine is running at a high-speed operation that a rotational speed of the internal combustion engine is greater than or equal to a predetermined speed.

5. The fuel injector according to claim 1, wherein when the valve body is closed, the elastic force of the elastic-force applying portion is referred to as Fsc, the elastic force of the elastic-force applying portion is referred to as Ffc, and the elastic coefficient K is set to meet a condition that $Fsc \geq Ffc$.

6. The fuel injector according to claim 1, wherein the valve body is slidable with respect to the movable core, the elastic-force applying portion has a main spring which is a spring applying the elastic force to the valve body in the valve-closing direction, and is provided to increase the elastic force in the valve-closing direction in accordance with an increase in stroke of the valve body, and a sub spring which is a spring applying the elastic force to the valve body via the movable core in the valve-opening direction, and is provided to decrease the elastic force in a valve-opening direction in accordance with the increase in stroke of the valve body, and the elastic coefficient K is a value combined an elastic coefficient K1 of the main spring with an elastic coefficient K2 of the sub spring.

7. The fuel injector according to claim 6, wherein the elastic coefficient K1 is greater than the elastic coefficient K2.

8. The fuel injector according to claim 1, further comprising:

a seating surface ring-shaped and provided at an outer peripheral surface of the valve body, and a body defining the injection port, the body having a seated surface, wherein the seating surface abuts on the seated surface to close the injection port.

9. The fuel injector according to claim 8, wherein the seating surface has a curved portion.

10. A fuel injector comprising:

a coil generating a magnetic flux when being energized;

a stator core generating a part of a magnetic circuit as a passage of the magnetic flux, the stator core generating an electromagnetic force;

a movable core moved by the electromagnetic force;

a valve body moved together with the movable core, the valve body opening an injection port; and an elastic-force applying portion being elastically deformable according to a movement of the valve body to apply an elastic force to the valve body in a valve-closing direction, wherein an elastic coefficient of the elastic-force applying portion is set to meet a condition that a value of (Ffx+Lx×K) is continuously increased during a time period from a time point that the movement distance becomes Lx to a time point that the movement distance becomes L, wherein among fuel-pressure valve-closing forces applied to the valve body in the valve-closing direction by a fuel pressure, the fuel-pressure valve-closing force of when the valve body is moved to a predetermined position is referred to as Ffx, the movement distance of the valve body from a time point that the valve body is closed to a time point that the valve body is moved to the predetermined position is referred to as Lx, a movement distance of the valve body from the time point that the valve body is closed to a time point that the valve body is completely opened is referred to as L, and the elastic coefficient is referred to as K.

11. The fuel injector for a combustion system that has an internal combustion engine operating according to a combustion of fuel injected from the injection port, and a fuel pump driven by the internal combustion engine and generating the fuel pressure, according to claim 10, wherein the elastic coefficient K is set to meet the condition, when the internal combustion engine is running at an idle operation.

12. The fuel injector according to claim 11, wherein the elastic coefficient K is set not to meet the condition, when the internal combustion engine is running at a high-speed operation that a rotational speed of the internal combustion engine is greater than or equal to a predetermined speed.

13. The fuel injector according to claim 10, wherein when the valve body is closed, the elastic force of the elastic-force applying portion is referred to as Fsc, the elastic force of the elastic-force applying portion is referred to as Ffc, and the elastic coefficient K is set to meet a condition that Fsc≥Ffc.

14. The fuel injector according to claim 10, wherein the valve body is slidable with respect to the movable core, the elastic-force applying portion has a main spring which is a spring applying the elastic force to the valve body in the valve-closing direction, and is provided to increase the elastic force in the valve-closing direction in accordance with an increase in stroke of the valve body, and a sub spring which is a spring applying the elastic force to the valve body via the movable core in the valve-opening direction, and is provided to decrease the elastic force in a valve-opening direction in accordance with the increase in stroke of the valve body, and the elastic coefficient K is a value combined an elastic coefficient K1 of the main spring with an elastic coefficient K2 of the sub spring.

15. The fuel injector according to claim 14, wherein the elastic coefficient K1 is greater than the elastic coefficient K2.

16. The fuel injector according to claim 10, further comprising:

a seating surface ring-shaped and provided at an outer peripheral surface of the valve body, and a body defining the injection port, the body having a seated surface, wherein the seating surface abuts on the seated surface to close the injection port.

17. The fuel injector according to claim 16, wherein the seating surface has a curved portion.

18. A fuel injection device comprising:

the fuel injector according to claim 1;

a control portion controlling an injection state of fuel injected from the injection port by controlling a coil current flowing through the coil, wherein the control portion has an increasing control portion which applies a voltage to the coil to increase the coil current to a first target value, and a pick-up control portion which applies a voltage to the coil to hold the coil current to a second target value that is less than or equal to the first target value, after the coil current is increased by the increasing control portion, the maximum value of the electromagnetic force required for starting to open the valve body is referred to as a required valve-opening force, the electromagnetic force that is saturated by holding the coil current to the second target value is referred to as a static attractive-force, and the second target value is set such that the static attractive-force is greater than or equal to the required valve-opening force.

19. A fuel injection device comprising:

the fuel injector according to claim 10;

a control portion controlling an injection state of fuel injected from the injection port by controlling a coil current flowing through the coil, wherein the control portion has an increasing control portion which applies a voltage to the coil to increase the coil current to a first target value, and a pick-up control portion which applies a voltage to the coil to hold the coil current to a second target value that is less than or equal to the first target value, after the coil current is increased by the increasing control portion, the maximum value of the electromagnetic force required for starting to open the valve body is referred to as a required valve-opening force, the electromagnetic force that is saturated by holding the coil current to the second target value is referred to as a static attractive-force, and the second target value is set such that the static attractive-force is greater than or equal to the required valve-opening force.

* * * * *